US006137748A

United States Patent [19]

Murakami

[11] Patent Number: 6,137,748

[45] Date of Patent: Oct. 24, 2000

[54] ELECTRONIC TIMEPIECE EQUIPPED WITH CALENDAR FUNCTION

[75] Inventor: Tomomi Murakami, Tanashi, Japan

[73] Assignee: Citizen Watch Co., Ltd., Tokyo, Japan

[21] Appl. No.: 09/065,015

[22] PCT Filed: Aug. 20, 1997

[86] PCT No.: PCT/JP97/02891

§ 371 Date: May 5, 1998

§ 102(e) Date: May 5, 1998

[87] PCT Pub. No.: WO98/09201

PCT Pub. Date: Mar. 5, 1998

[30] Foreign Application Priority Data

Aug. 26, 1996 [JP] Japan ..... 8-223671

[51] Int. Cl.[7] ..... G04B 9/00

[52] U.S. Cl. ..... 368/66; 368/204

[58] Field of Search ..... 368/66, 64, 203, 368/204, 28, 34, 31

[56] References Cited

U.S. PATENT DOCUMENTS 5,889,736 3/1999 Fujita et al. ..... 368/66

FOREIGN PATENT DOCUMENTS 51-141670 12/1976 Japan .
54-28659 3/1979 Japan .
54-98135 7/1979 Japan .
56-172787 12/1981 Japan .
61-80482 5/1986 Japan .

*Primary Examiner*—Bernard Roskoski
*Attorney, Agent, or Firm*—Kanesaka & Takeuchi

[57] ABSTRACT

An electronic timepiece includes a time counter (19) for counting time reference signals, a calendar hand moving device (20) for moving hands in accordance with the count content of the time counter, a cover open/close switch (15) for sensing opening/closing of a timepiece cover and time information setting means for setting time calendar information when the timepiece cover is opened. The time counter (19) is constituted so that it counts the time reference signals by using the time information set by the time information setting means as the reference, and the time information setting means includes an electrode code plate (10) having a plurality of electrodes (10A) that can be electrically connected by an conductive material such as a pencil, a detection circuit (12) for judging the connection between the electrodes and a memory circuit (14) for judging the connection between the electrodes, converting it to time information and storing the time information.

7 Claims, 4 Drawing Sheets

ELECTRONIC TIMEPIECE EQUIPPED WITH CALENDAR FUNCTION

FIELD OF THE INVENTION

This invention relates to an electronic timepiece equipped with a calendar function, and, especially, to an electronic time piece equipped with a system for automatically executing the month-end amendment for a calendar when a battery is replaced.

DESCRIPTION OF THE BACKGROUND ART

Conventionally, a number of electronic wrist watches provided with a calendar function is on the market. These watches include commercial products in which a microcomputer is used to amend a calendar. Initial data, specifically, the month, day, and time at the start of operation of a watch is set by operating a plurality of buttons. Also, the number of days from the start of operation is counted to discriminate which type of month is, specifically, a 31-day month or a month with thirty or less day at the end of the month, thereby amending the displays of the month and day.

In these electronic timepieces, replacement of a battery is inevitable. When a battery is removed for replacement, the time information which has been stored up to that time is cleared. In this case, it has been proposed to adopt a system used in many electric devices in which a secondary power source differing from the primary power source operates to store the time information and the like which must not be lost, the secondary power source is always replenished by a charge from the primary power source, and the secondary power source operates to maintain the memory during replacement of the primary power source. However, it is difficult to incorporate such a system into devices such as electronic timepieces, particularly electronic wrist watches, which are made more convenient by a reduction in size.

In addition, there is the case where watches in the condition that a battery runs out are allowed to stand for over several weeks or several months. Even if the aforementioned system in which the time information is protected using the secondary power source could be realized, such a system would not meet the requirements of this case. There is, among other measures, one in which a non-volatile substance is used to memorize the time information just before a battery runs out and driving hands are suspended. Even such measures are of no use if the period of time during which the watch is allowed to stand is long.

Because of the aforementioned reasons, the above electronic timepieces in which a calendar is corrected using a microcomputer prevail in the market at present.

However, in such an electronic timepiece, as mentioned above, not only a very complicated operation is required to set the initial data when replacing a battery but also the watch must be provided with a number of operating buttons. This causes the decorative shape of the watch to be restricted. Also, since the life of the battery is very long, there is the problem that one may forget how to operate buttons for amending the calendar when the battery is replaced next time.

In view of this situation, it is an object of the present invention to provide an electronic timepiece equipped with a calendar function in which the initial data when a battery is replaced can be set exactly by a simple operation without the necessity for a button attached to the casing of the watch for executing this operation.

DISCLOSURE OF THE INVENTION

The above objects can be attained in the present invention by the provision of an electronic timepiece equipped with a calendar function comprising a time counter for counting time reference signals, a calendar hand driving device for moving hands in accordance with to the count content of the time counter, a cover open/close switch for sensing opening/closing of a timepiece cover and time information setting means for setting time calendar information when the timepiece cover is opened, wherein the time counter counts time reference signals by using the time information set by the time information setting means as the reference.

In a preferred embodiment of the present invention, the time information setting means includes an electrode code plate having a plurality of electrodes that can be electrically connected by an electroconductive material, a detection circuit for judging the connection between the electrodes and a memory circuit for judging the connection between the electrodes, converting it to time information storing the time information; and the electrodes arranged on the electrode plate are each placed at a position where the segments cross in a digital display.

The electronic timepiece equipped with a calendar function of the present invention is featured in that, when a battery is replaced, the time calendar information at the time when the battery is replaced can be set only by painting over spaces between electrodes using an electroconductive material such as a pencil mark or the like and month-end treatment can be executed without the provision of extra operating buttons, exerting no remarkable influence on the design of the watch.

Also, the electronic timepiece of the present invention requires no structurally complicated mechanisms, and therefore it has a simple structure and is produced at very low cost.

Furthermore, the operation of the watch is not influenced even in the case where the life of a battery is running out and the watch is allowed to stand for several days or several months. If the time calendar information at that time is input (written in), the number of days is counted from that time to exactly drive the hands for the day display.

DETAILED DESCRIPTION OF THE INVENTION AND PREFERRED EMBODIMENTS

The present invention will now be explained in detail with reference to the appended drawings.

Figure 1:
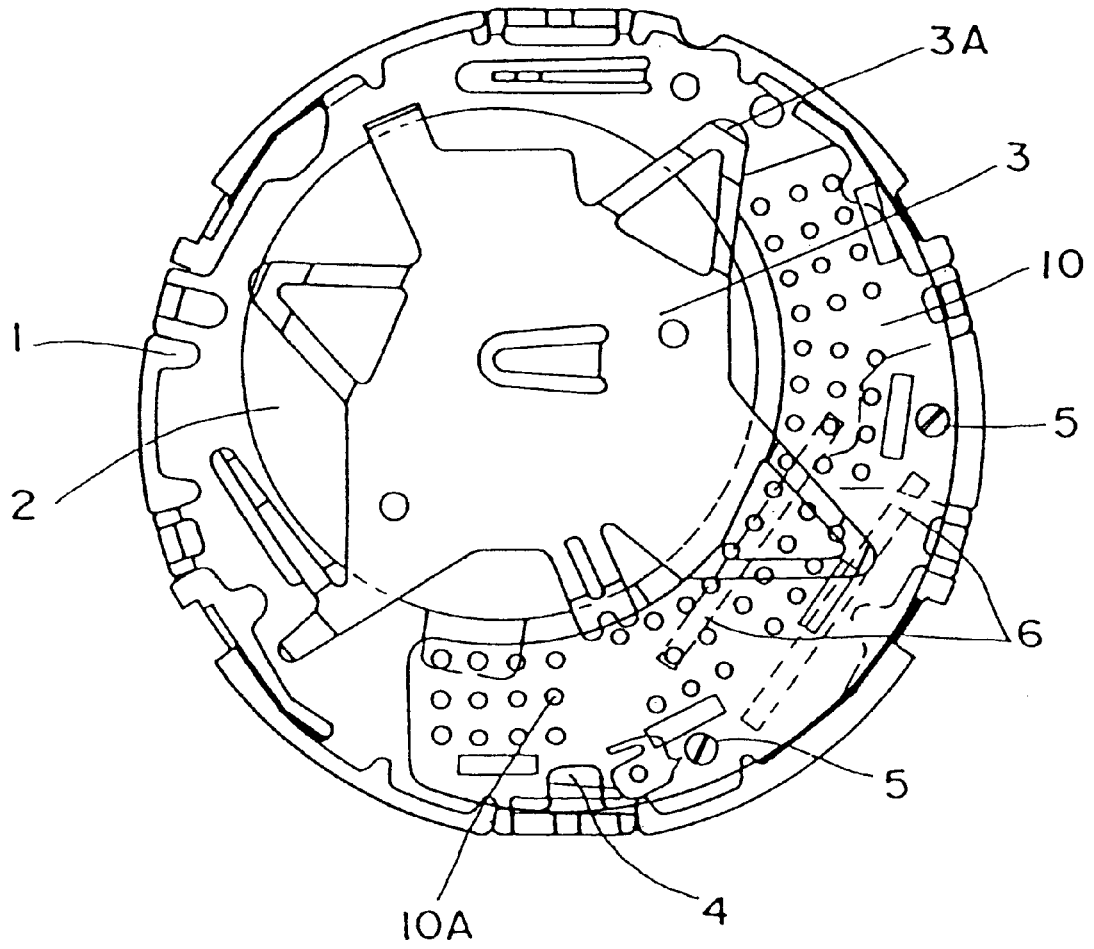
FIG. 1 is a top plan view of an analog display electronic timepiece which is observed from the back side of the casing showing a preferred embodiment of the present invention.

FIG. 1 is a top plan view of a movement of the analog display electronic timepiece of the present embodiment which is observed from the back side of the casing.

This analog display electronic timepiece possesses a motor for driving a hand for a day display other than the usual motor for driving an hour hand, minute hand, and second hand of a watch. Also, members required for an analog watch are incorporated into a watch movement, though not shown. As shown in FIG. 1, a battery 2 is incorporated into a movement 1. This battery 2 is secured by a battery pressure bar spring 3 and the anode (+side) of the battery 2 is connected to a watch case which is not shown. The battery pressure bar spring 3 includes a convex spring portion 3A which is in contact with a case back (not shown). The anode (+side) of the battery 2 is connected to the watch case (not shown) via the case back.

A cover open/close switch 4 comes into contact with the case back when the case back of the watch is closed and electrically opens circuits when the case back of the watch is removed. The cover open/close switch 4 opens circuits when the case back is opened to replace a battery or the like and comes into contact with the case back to connect electrically with the anode of the battery 2 via the case back when the case back is closed after a battery is replaced. A screw 5 is used to secure an electrode code plate 10 to the movement 1 of the watch. A connecting material 6 electrically connects a watch circuit built into the watch movement 1 with each electrode 10A of the electrode code plate 10 when the electrode code plate 10 is secured to the watch movement 1.

Figure 2:
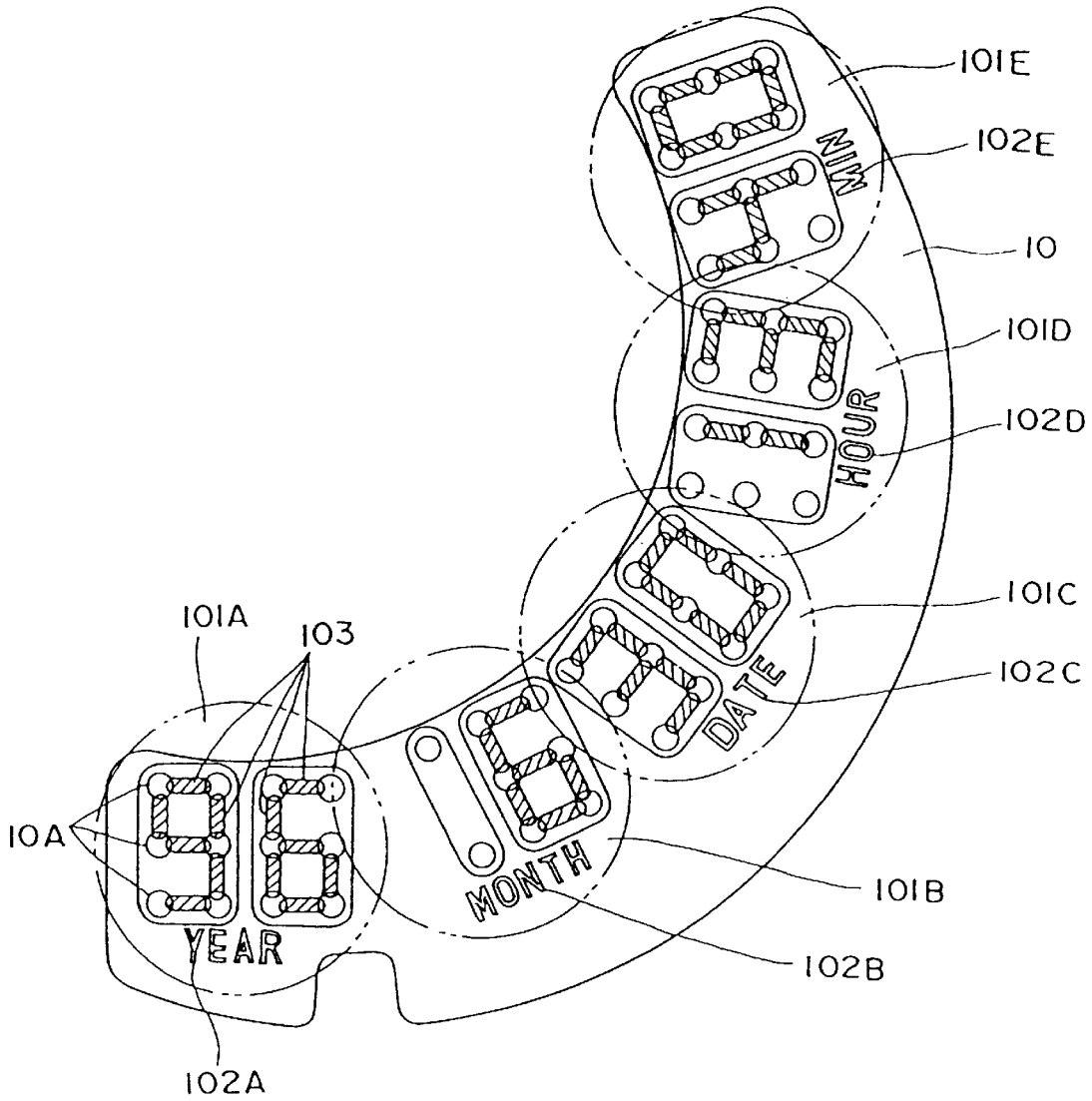
FIG. 2 is an enlarged top plan view of the electrode code plate shown in FIG. 1.

FIG. 2 is an enlarged top plan view of the electrode code plate 10.

As shown in FIGS. 1 and 2, the electrode code plate 10 has a structure wherein the electrode 10A is arranged in the form of a matrix on the surface of a substrate provided with wiring on the back face thereof.

The electrode 10A arranged like a matrix is disposed in such a manner that it is divided into five blocks as shown in the figure. A year code block 101A is constituted of 12 electrodes 10A and an adjacent month block 101B is constituted of 8 electrodes 10A. Further, a day code block 101C, an hour code block 101D, and a minute code block 101E are respectively constituted of 12 electrodes 10A.

As shown in FIG. 2, the electrode 10A is disposed at each cross point of seven segments used for general digital display. Each electrode 10A is connected to another electrode 10A using an electroconductive material 103 to display a time calendar of each digit. Also, the electrode code plate 10 is provided with a year mark 102A for indicating that the year code block is a block for setting the year. Similarly, the electrode code plate 10 is provided with a month mark 102B, a day mark 102C, an hour mark 102D, and a minute mark 102E which indicate that the blocks 101B, 101C, 101D, and 101E are blocks for setting the month, day, hour, and minute respectively.

In addition, as shown in FIG. 2, the space between the electrodes 10A is painted over using an electroconductive material such as a pencil mark 103, whereby the electrodes 10A are connected to each other. Specifically, as shown in FIG. 2, the electrodes 10A are connected to each other via the pencil mark 103 to display "96" in the area of the year code block 101A, "6" in the area of the month code block 101B, "30" in the area of the day code block 10C, "13" in the area of the hour code block 101D, and "40" in the area of minute code block 101E. In other word, the electrodes 10A are connected to each other to display "96 (year): 6 (month): 30 (day): 13 (hour): 40 (minute).

Next, a system for automatically executing a month-end amendment is now explained with reference to FIGS. 3 and 4.

Figure 3:
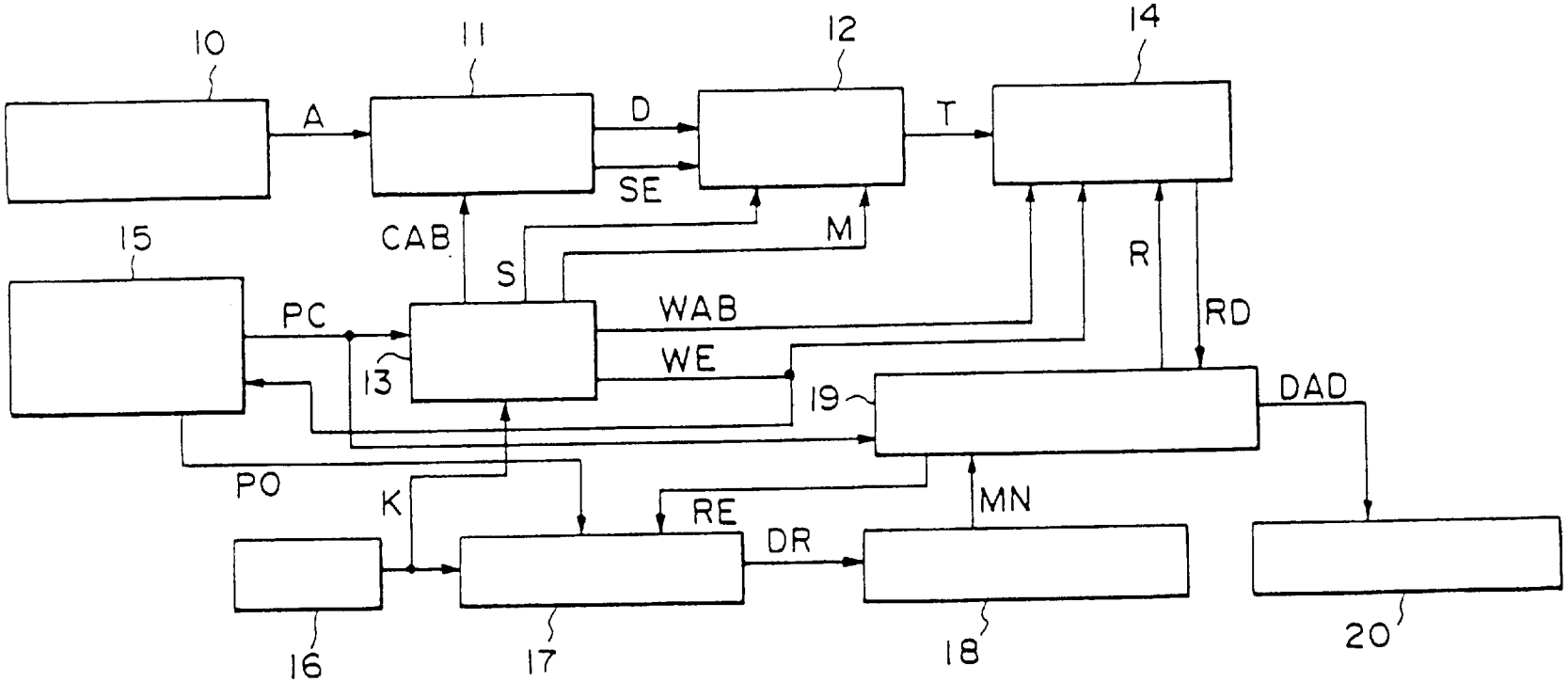
FIG. 3 is a system block diagram showing the entire system of the present embodiment.
Figure 4:
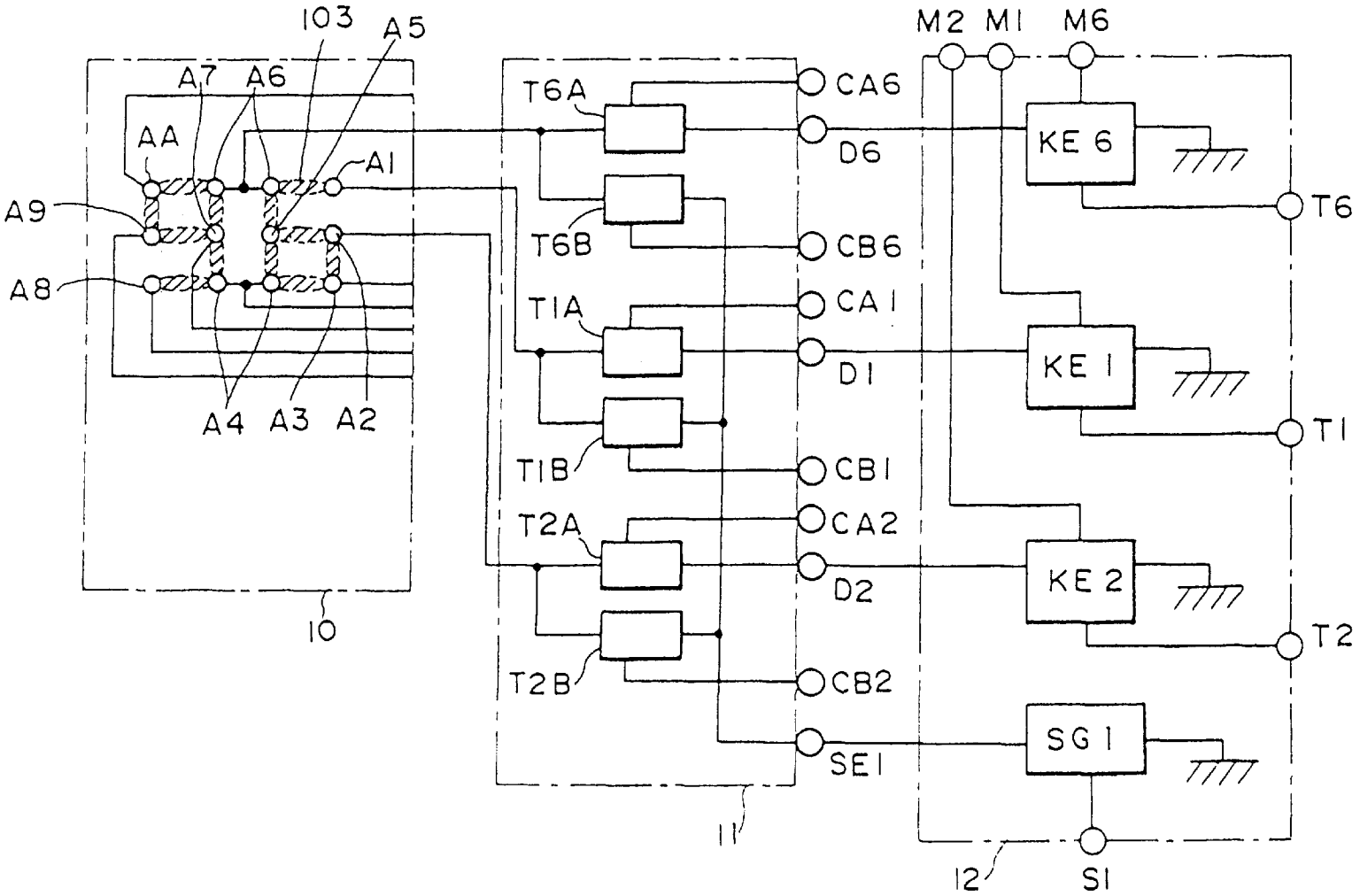
FIG. 4 is a detailed view for explaining in detail each part of the electrode code plate, switching block, and detection circuit 12 shown in FIG. 3.

FIG. 3 is a block diagram showing a system and FIG. 4 is a detailed view for explaining in detail each part of the electrode code plate, switching block, and detection circuit shown in FIG. 3.

In this system, an electrode signal A is output from the electrode code plate 10 to each electrode 10A. A switching block 11 switches the combinations of electrode signals A to measure the resistance between the electrodes 10A on the electrode code plate 10. This switching block 11 controls inner switching elements by a switch control signal CAB from a timing generating circuit 13 as mentioned below. A detection circuit 12 measures the resistance between each D terminal and each corresponding SE terminal in the switching block 11 shown in FIG. 4, to determine that the above pencil mark 103 is interposed between the electrodes 10A of the electrode code plate 10 if the detected resistance is lower than a prescribed value, and to output the result as data T between terminals. The detection circuit 12 measures the resistance between each D terminal and each corresponding SE terminal in accordance with the timing directed by a block control signal S and a measuring signal M which are output from a timing generating circuit 13 mentioned below.

The timing generating circuit 13 receives a case back closing signal PC from a cover open/close switch circuit 15 and then sequentially outputs the switch control signal CAB, the block control signal S, the measuring signal M, a writing signal WAB, and a writing termination signal WE. A memory circuit 14 stores the data T between electrodes 10A in accordance with the input timing of the writing signal WAB and acquires each time data of "year, month, day, hour, and minute" as case back closing time data RD to output the data.

A cover open/close switch circuit 15 outputs a case back opening signal PO when the cover open/close switch 4 is free from contact with the case back. When the cover open/close switch 4 remains in contact with the case back for 15 seconds one minute or more after the case back opening signal PO is output, the switch 15 outputs a case back closing signal PC. A reference signal generating circuit 16 outputs a reference signal K.

A dividing circuit 17 divides the reference signal K to output a watch hand driving signal DR. This dividing circuit 17 suspends the output of the watch hand driving signal DR according to the input of the case back opening signal PO and resets an inner counter according to the input of a reset signal RE. A watch hand driving device 18 drives a hand at intervals of one second for general time display and outputs a minute signal MN every one minute.

A time counter 19 counts the minute signal MN to construct time calendar information from a minute digit to a year digit. This time counter 19 receives one minute signal MN each time the date changes, specifically, at 23 (hour): 59 (minute) and outputs a day hand driving signal DAD at 0 (hour): 00 (minute). The time counter 19 also receives one minute signal MN when carrying a date digit and a month digit, for example, at 4 (month): 30 (day): 23 (hour): 59 (minute) and outputs two pulses of a day hand driving signal DAD at 5 (month): 1 (day): 0 (hour): 00 (minute). The time counter 19 possesses the function of determining information from the time calendar to control the number of outputs of the day hand driving signal DAD in this manner. In other words, the time counter 19 discriminates which month it is, specifically, a 31-day month or a month with thirty or less days and whether it is a leap year or not, to control the number of outputs of the day hand driving signal DAD. A calendar hand moving device 20 drives a day display hand according to the input of the day hand driving signal DAD.

Next, parts of the electrode code plate 10, switching block 11, and detection circuit 12 are explained in detail with reference to FIG. 4.

In the figure, each symbol represents the same component as above .

The electrode code plate 10 shown in FIG. 4 is represented by a year code block 101 A which is a part thereof. In FIG. 4, the electrode 10A disposed on the electrode code plate 10 is explained in more detail. In the range of the year code block 101A, 12 electrodes 10A are arranged. Among these, two pairs (A4 and A6 as described below) are electrically the same. 12 electrodes 10A are therefore symbolized as 10 electrodes A1 to AA as shown in the figure. In the figure, the hatched pencil mark 103 serves to connect specific electrodes to each other.

Here, the connections between the electrodes A1, A2, and A6 on the electrode code plate 10 and the switching block 11 shown in FIG. 4 are explained. In the switching block 11, two transmission gates are connected to one electrode. For example, transmission gates T1A and T1B are connected to the electrode A1. When a control signal is input to a control terminal CA1 of the transmission gate T1A, the electrode A1 is electrically connected to a terminal D1 of the transmission gate T1A, and when a control signal is input to a control terminal CB1 of the transmission gate T1B, the electrode A1 is electrically connected to a terminal SE1 of the transmission gate T1B. Transmission gates T2A and T2B connected to the electrode A2, and transmission gates T6A and T6B connected to the electrode A6, also act similarly.

Further, D terminals D1, D2, and D6 of the switching block 11 are connected to detecting elements KE1, KE2, and KE6 installed inside the detection circuit 12 respectively. The detecting elements KE1, KE2, and KE6 measure each resistance between the D terminals and the ground according to input of measuring signals M1, M2, and M6 to output "1" if the resulting resistance is lower than a prescribed value and "0" if the resulting resistance is a prescribed value or high from each of the T terminals T1, T2, and T6. A transmission gate SG1 of the detection circuit 12 serves to ground an S terminal SE1 of the switching block 11 according to the input block control signal S1.

The actions of the electronic timepiece of the present invention are now explained. First, when the replacement of a battery is required along with the termination of the life of the battery of the electronic timepiece, the case back of the watch is opened. When the case back is opened, the cover open/close switch 4 is in an open condition whereby it does not contact the case back. When the cover open/close switch 4 is in an open condition, the cover open/close switch circuit 15 outputs the case back opening signal PO. The dividing circuit 17 receives the case back opening signal PO and terminates the output of the hand driving signal DR. The operation of the watch stops on termination of the output of the hand driving signal DR.

A battery replacement operation is carried out in such a condition that the operation of the watch is suspended. Specifically, the battery pressure bar spring 3 is removed from the watch movement 1 to replace the battery 2 with a new battery which is then secured to the watch movement 1 using the battery pressure bar spring 3. Next, the screw 5 securing the electrode code plate 10 is removed to remove the electrode code plate 10. Then, the instant calendar information is written in using a pencil mark. For example, if that time is 1990 (year): 6 (month): 30 (day): 13 (hour): 40 (minute), the time information is written in using a pencil mark as shown in FIG. 2.

Next, the electrode code plate 10 is attached to the watch movement 1 using the screw 5. The electrode code plate 10 is electrically connected to a watch circuit of the watch movement 1 using the connecting material 6. The case back is then closed, whereby the cover open/close switch 4 is allowed to come into contact with the case back and thereby to connect electrically to a battery source.

When the case back is closed, on the other hand, the cover open/close switch circuit 15 stops the output of the case back opening signal PO and further outputs the case back closing signal PC after the cover open/close switch 4 is in contact with the case back for 15 seconds. The time counter 19 is maintained in a reset condition when the case back closing signal PC is input. Also, the timing generating circuit 13 sequentially starts to output the switch control signal CAB, the block control signal S, and the measuring signal M by inputting the case back closing signal PC.

The details are now explained with reference to FIG. 4, with respect only to the year code block 101A. In the year code block 101A, the pencil mark 103 is written in so that the year code block 101A displays "96" as shown in FIG. 4. Because of this, explanations are given with respect to the electrodes A1, A2, and A6.

The electrode A1 is electrically connected to the transmission gates T1A and T1B. The electrode A2 is electrically connected to the transmission gates T2A and T2B. The electrode A6 is electrically connected to the transmission gates T6A and T6B.

Among the pairs of transmission gates, one party, specifically, all of the transmission gates T1B, T2B, and T6B is electrically connect to the SE1 terminal of the switching block 11. The other party, specifically, the transmission gates T1A, T2A, and T6A are electrically connect to each of the corresponding output terminals D1, D2, and D6 respectively. These output terminals D1, D2, and D6 electrically connect to each of the corresponding detecting elements KE1, KE2, and KE6 of the detection circuit 12.

Here, when the block control signal S is output from the timing generating circuit 13, first, the year block control signal S1 is set to "1" since the reading for the year code block is carried out in this case, whereby the transmission gate SG1 is turned to "ON".

In this condition, at the timing for detecting the condition between the electrodes A1 and A2, only the switch control signals CA1 and CB2 from the timing generating circuit 13 are "1" at the same time. During this time, the measuring signal M1 from the timing generating circuit 13 is turned to "1". This allows the transmission gates T2B and T1A to be turned to "ON", whereby the detecting element KE1 measures the resistance between the electrodes A1 and A2. Then, based on the measured resistance, the detecting element KE1 outputs from the terminal T1 a signal "0" which shows that the electrodes A1 and A2 are not electrically connected to each other. This data output from the terminal T1 of the detection circuit 12 is stored in the memory circuit 14 as the data detected between the electrodes A1 and A2 according to the writing signal WAB during the period in which the measuring signal M1 is "1". With this, the measurement of the resistance between the electrodes A1 and A2 and the operation for storing the detected data are finished. Then, the switch control signals CA1 and CB2, the measuring signal M1, and the writing signal WAB which are output from the timing generating circuit 13 are turned to "0".

At the timing for detecting the condition between the electrodes A1 and A6, only the switch control signals CA6 and CB1 from the timing generating circuit 13 are "1" at the same time. During this time, the measuring signal M6 from the timing generating circuit 13 is turned to "1". This allows the transmission gates T1B and T6A to be turned "on", whereby the detecting element KE6 measures the resistance between the electrodes A1 and A6. Then, based on the measured resistance, the detecting element KE6 outputs from the terminal T6 a signal "1" which shows that the electrodes A1 and A6 are electrically connected to each other. This data output from the terminal T6 of the detection circuit 12 is stored in the memory circuit 14 as the data detected between the electrodes A1 and A2 according to the writing signal WAB during the period in which the measuring signal M6 is "1". With this, the measurement of the resistance between the electrodes A1 and A6 and the operation for storing the detected data are finished. Then, the switch control signals CA6 and CB1, the measuring signal M1, and the writing signal WAB which are output from the timing generating circuit 13 are turned to "0".

In this manner, a step in which the transmission gate is selectively turned to "ON" for every electrode, the resistance between the electrodes is measured, and the measured data is written into the memory circuit 14, is repeated to finish writing of the content of the year code block 101A. Then, the year block control signal S1 from the timing generating circuit 13 is turned to "0". When the reading and writing of the data between all electrodes for the month code block 101B, day code block 101C, hour code block 101D, and minute code block 101E are completed in the same manner as above, the timing generating circuit 13 outputs a writing finishing signal WE.

The cover open/close switch circuit 15 terminates the output of the case back closing signal PC when the writing finishing signal WE is input to the cover open/close switch circuit 15. On the other hand, the memory circuit 14 converts the read data into each set of time data "year, month, day, hour, and minute" which is the case back closing time data RD, when the writing finishing signal WE is input to the memory circuit 14.

The time counter 19 outputs a reading signal R to the memory circuit 14 when the input of the case back closing signal PC terminates. The memory circuit 14 to which the reading signal R is input outputs the stored case back closing time data RD to the time counter 19. Then, the time counter 19 sets a counter content to the time data RD and releases the output of the reset signal RE and starts to count the minute signal MN output from the watch hand driving device 18.

The time counter 19 counts the minute signal MN from the input time data RD and outputs the day display hand driving signal DAD at the time of carrying a date digit. Also, when carrying a data digit in a month with thirty or less days, the time counter 19 outputs the day display hand driving signal DAD twice. Further, the time counter 19 discriminates whether it is a leap year or a common year at the end of February and outputs the day display hand driving signal DAD corresponding to that particular year.

In the present embodiment, the electrode 10A is disposed on the electrode code plate 10 at each cross point of seven segments used for a common digital display. A means is practical in which, on the contrary, each segment is disposed as the electrode 10A and segments required for displaying the time calendar information are connected to each other.

Also, the present invention can be practiced by the method in which electrodes 10A of all segments are connected to each other using an electroconductive material and, in this condition, the electroconductive material between electrodes, which is not required for the display of time calendar information, is allowed to burn out.

As the electroconductive material used in the present invention, electroconductive material other than a pencil mark, for example, electroconductive adhesives or the like may be used.

INDUSTRIAL APPLICABILITY

As is clear from the above illustrations, the electronic timepiece equipped with a calendar function of the present invention can be adequately utilized not only for common watches but also various electronic devices with a built-in electronic timepiece equipped with a calendar function, such as a portable telephone, pager, or the like.

What is claimed is:

1. An electronic timepiece equipped with a calendar function comprising a time counter for counting time reference signals, a calendar hand moving device for moving hands in accordance with a count content of the time counter, a cover open/close switch for sensing opening/closing of a timepiece cover, and time information setting means for setting time calendar information when the timepiece cover is opened, wherein the time counter counts the time reference signals by using the time calendar information set by the time information setting means as a reference.

2. The electronic timepiece equipped with a calendar function according to claim 1, wherein the time information setting means includes an electrode code plate having a plurality of electrodes that can be electrically connected by a conductive material, a detection circuit for judging a connection between the electrodes and a memory circuit for judging the connection between the electrodes, converting it to time information and storing of the time information.

3. The electronic timepiece equipped with a calendar function according to claim 2, wherein the time information setting means includes a timing generating circuit which receives a signal from the cover open/close switch and a signal from reference signal generating means and, according to these signals, outputs an operating signal to the detection circuit and the memory circuit.

4. The electronic timepiece equipped with a calendar function according to claim 2, wherein the electrodes arranged on the electrode code plate are placed at crossed positions of segments in a digital display.

5. The electronic timepiece equipped with a calendar function according to claim 2, wherein the electrodes arranged on the electrode plate are each disposed as a segment in a digital display.

6. The electronic timepiece equipped with a calendar function according to claim 4, wherein a space between the electrodes is electrically connected by painting over the space using an electroconductive material including a pencil mark.

7. The electronic timepiece equipped with a calendar function according to claim 2, wherein the electrode plate is in a condition where the electrodes of all segments are connected by using an electroconductive material and the electroconductive material which is not required for setting the time information for year, month, day, hour, and minute is burned out.

* * * * *